US010905298B2

(12) United States Patent
Cheung et al.

(10) Patent No.: US 10,905,298 B2
(45) Date of Patent: Feb. 2, 2021

(54) CLEANING EQUIPMENT

(71) Applicant: Shenzhen Silver Star Intelligent Technology Co., Ltd., Guangdong (CN)

(72) Inventors: Guodong Cheung, Guangdong (CN); Changtai Har, Guangdong (CN)

(73) Assignee: SHENZHEN SILVER STAR INTELLIGENT TECHNOLOGY CO., LTD., Shenzhen (CN)

( * ) Notice: Subject to any disclaimer, the term of this patent is extended or adjusted under 35 U.S.C. 154(b) by 299 days.

(21) Appl. No.: 15/871,432

(22) Filed: Jan. 15, 2018

(65) Prior Publication Data

US 2018/0317724 A1 Nov. 8, 2018

Related U.S. Application Data

(63) Continuation of application No. PCT/CN2017/114300, filed on Dec. 1, 2017.

(30) Foreign Application Priority Data

May 3, 2017 (CN) ..... 2017 2 0478253 U

(51) Int. Cl.

| | |
|---|---|
| ***A47L 9/04*** | (2006.01) |
| ***A47L 9/06*** | (2006.01) |
| ***A47L 9/00*** | (2006.01) |
| ***A47L 9/14*** | (2006.01) |
| ***A47L 9/28*** | (2006.01) |

(52) U.S. Cl.

CPC ..... *A47L 9/0488* (2013.01); *A47L 9/009* (2013.01); *A47L 9/0466* (2013.01); (Continued)

(58) Field of Classification Search

CPC .. A47L 9/2842; A47L 9/2857; A47L 2201/00; A47L 9/2889; A47L 9/2805; (Continued)

(56) References Cited

U.S. PATENT DOCUMENTS

2008/0065265 A1* 3/2008 Ozick ..... G05D 1/0231 700/245
2008/0276408 A1* 11/2008 Gilbert, Jr. ..... A47L 11/34 15/320

(Continued)

FOREIGN PATENT DOCUMENTS

CN 202313128 7/2012
CN 103860105 6/2014

(Continued)

*Primary Examiner* — Robert J Scruggs
(74) *Attorney, Agent, or Firm* — IPro, PLLC

(57) ABSTRACT

A cleaning equipment is disclosed, which includes a housing, a moving assembly, a cleaning assembly and a cliff sensor, the cliff sensor being arranged on the housing, the moving assembly or the cleaning assembly; the cleaning assembly includes at least one first cleaning sub-assembly which includes an installing part, a first component and at least one second component; the first component and the second component extend outwards and rotate along with rotation of the installing part so as to stir dirt on the surface to be cleaned; the first component passes through the gap between the housing and the surface to be cleaned while rotating, while the second component does not pass through the gap while rotating. The cleaning equipment lowers frequency of blocking the cliff sensor from transmitting and receiving signal art, and improves detecting accuracy of the cliff sensor.

12 Claims, 9 Drawing Sheets

(52) U.S. Cl.
CPC ..... *A47L 9/0477* (2013.01); *A47L 9/0686* (2013.01); *A47L 9/1409* (2013.01); *A47L 9/2805* (2013.01); *A47L 2201/04* (2013.01)

(58) Field of Classification Search
CPC ..... A47L 9/0488; A47L 9/009; A47L 9/0466; A47L 9/0477; A47L 9/0686; A47L 9/1409; A47L 2201/04; A47L 9/04; A47L 9/00; A47L 9/06; A47L 9/14; A47L 9/28
See application file for complete search history.

(56) References Cited

U.S. PATENT DOCUMENTS

| | | | | |
|---|---|---|---|---|
| 2011/0245972 | A1 | 10/2011 | Yan | |
| 2012/0090133 | A1* | 4/2012 | Kim | A47L 9/0433 15/391 |
| 2012/0110775 | A1* | 5/2012 | Krebs | A47L 9/0472 15/347 |
| 2016/0157692 | A1* | 6/2016 | Maoro | A46B 9/02 15/300.1 |
| 2016/0166127 | A1* | 6/2016 | Lewis | A47L 9/0477 15/49.1 |
| 2016/0206164 | A1* | 7/2016 | Oka | A47L 5/30 |

FOREIGN PATENT DOCUMENTS

| | | |
|---|---|---|
| CN | 104000541 | 8/2014 |
| CN | 104216404 | 12/2014 |
| CN | 105310606 | 2/2016 |
| CN | 205094339 | 3/2016 |
| CN | 106419760 | 2/2017 |
| CN | 106993987 | 8/2017 |

* cited by examiner

CLEANING EQUIPMENT

CROSS-REFERENCE TO RELATED APPLICATION

The present application is a continuation of International Patent Application No. PCT/CN2017/114300, filed on Dec. 1, 2017, which claims priority to Chinese Patent Application No. 201720478253.9, filed May 3, 2017, titled Cleaning Equipment, both of which are herein incorporated by reference.

FIELD OF THE INVENTION

The present application relates to cleaning area, especially to a cleaning equipment.

BACKGROUND OF THE INVENTION

Cleaning equipment is provided with manual operated, full automatic or semi-automatic intelligent equipment for cleaning. Current cleaning equipment generally includes a base plate for supporting various elements, a side brush arranged along a periphery of the base plate, a trash bin, a moving assembly and cliff sensors for detecting the ground. The side brush, the trash bin and the cliff sensor are all disposed on the base plate. The side brush is disposed in front of the trash bin such that the side brush may collect the dirt on the surface to be cleaned (such as ground) into the trash bin, for that the trash bin can direct the dirt to the entrance of the trash bin while it is rotating. In order to keep the moving assembly from moving towards the cliff boundary (such as steps) of the ground, the cliff sensor should be disposed in front of the moving assembly. Therefore, in the prior art, the side brush and the cliff sensor are both disposed in the front part of the cleaning equipment and in front of the moving assembly.

In the prior art, the side brush includes several bristles and protrudes outside the periphery of the base plate. While rotating, the side brush would frequently block the cliff sensor from transmitting or receiving optical signal, which lowers detecting accuracy of the cliff sensor. For example, in the case that the cleaning equipment is cleaning at the corridor of the second floor along which there exist steps that lead to the first floor, when the cleaning equipment arrives at the junction between the corridor and the steps, the side brush blocks the cliff sensor frequently may make the cleaning equipment unable to detect a cliff on the ground, thus further make the cleaning equipment move towards the cliff, thereby making the cleaning equipment fallen and damaged, or stuck in the cliff boundary and unable to redirect in time.

SUMMARY OF THE INVENTION

One object of the present invention is to provide a cleaning equipment which lowers frequency of blocking a cliff sensor from transmitting and receiving signal, and improves detecting accuracy of the cliff sensor.

Firstly, one embodiment of the present application provides a cleaning equipment which includes:

a housing;

a moving assembly, which is arranged combining with the housing, and configured to move the cleaning equipment;

a cleaning assembly, which is arranged combining with the housing, and configured to clean a surface to be cleaned; and at least one cliff sensor, which is arranged on one of the housing, the moving assembly and the cleaning assembly, and the cliff sensor faces towards the surface to be cleaned;

wherein, the cleaning assembly includes at least one first cleaning sub-assembly which includes an installing part and a first component; the first component extends towards a periphery of the housing from the installing part, and rotates along with rotation of the installing part so as to stir dirt on the surface to be cleaned.

In one embodiment, the first cleaning sub-assembly further includes at least one second component which extends outwards from the installing part; the first component passes through between the cliff sensor and the surface to be cleaned while rotating; the second component does not pass through the gap between the cliff sensor and the surface to be cleaned while rotating.

In one embodiment, the first cleaning sub-assembly further includes a shape stabilizing part which connects a part of the first component close to the installing part with a part of the second component close to installing part.

In one embodiment, the first cleaning sub-assembly includes one first component and one second component; the shape stabilizing assembly includes a connecting part and a coating part, the connecting part being located between the first component and the second component, the coating part coating the part of the first component close to the installing part and the part of the second component close to installing part.

In one embodiment, the first cleaning sub-assembly includes one first component and multiple second components; the shape stabilizing assembly includes a connecting part and a coating part, the connecting part being located between every two second components and between the first component and the second components, the coating part coating the part of the first component close to the installing part and the parts of each of the second components close to installing part.

In one embodiment, the connecting part is thinner than the coating part.

In one embodiment, the shape stabilizing part is made from elastic material.

In one embodiment, the first component is made from bristle, elastic rubber, cloth or fiber; the second component is made from bristle, elastic rubber, cloth or fiber.

In one embodiment, the first component and/or the second component include an extending strip, one end of which is connected with the installing part, the other end of which is provided with a flexible part.

In one embodiment the cleaning assembly further includes a second cleaning sub-assembly which includes a dirt absorbing unit that is intercommunicated with the dirt collecting assembly; the first component and the second component stir the dirt to guide the dirt into the dirt absorbing unit which further collects the dirt into the dirt collecting assembly.

Secondly, another embodiment of the present application provides another cleaning equipment which includes:

a housing;

a moving assembly, which is arranged combining with the housing, and configured to drive the cleaning equipment to move;

a dirt collecting assembly, which is arranged in the housing, and configured to collect dirt;

a cleaning assembly, which is arranged combining with the housing, and configured to clean a surface to be cleaned, the cleaning assembly including at least one first cleaning sub-assembly and one second cleaning sub-assembly which includes a dirt absorbing unit that is intercommunicated with the dirt collecting assembly; and a cliff sensor, which is arranged on at least one of the housing, the moving assembly and the cleaning assembly, and faces towards the surface to be cleaned;

wherein, the cleaning assembly includes at least one first cleaning sub-assembly which includes an installing part, a first component and at least one second component; the first component and the second component extend outwards from the installing part, and rotate along with rotation of the installing part so as to stir dirt on the surface to be cleaned; the first component passes through the gap between the housing and the surface to be cleaned while rotating, while the second component does not passes through the gap between the housing and the surface to be cleaned while rotating.

Thirdly, another embodiment of the present application provides another cleaning equipment which includes:

a housing;

a moving assembly, which is arranged partially within the housing, and configured to drive the cleaning equipment to move;

a dirt collecting assembly, which is arranged partially within the housing, and configured to collect dirt;

a cleaning assembly, which is arranged partially within the housing, and configured to clean a surface to be cleaned, the cleaning assembly including at least one first cleaning sub-assembly and one second cleaning sub-assembly which includes a dirt absorbing unit that is intercommunicated with the dirt collecting assembly; and a cliff sensor, which is arranged on at least one of the housing, the moving assembly and the cleaning assembly, and faces towards the surface to be cleaned;

wherein, the cleaning assembly includes at least one first cleaning sub-assembly which includes an installing part, a first component and at least one second component; the first component and the second component extend outwards from the installing part, and the first component is longer than the second component.

Fourthly, another embodiment of the present application provides another cleaning equipment which includes:

a housing;

a moving assembly, which is arranged combining with the housing, and configured to drive the cleaning equipment to move;

a dirt collecting assembly, which is arranged in the housing, and configured to collect dirt; and a cliff sensor, which is arranged on at least one of the moving assembly and the cleaning assembly, and faces towards the surface to be cleaned.

Compared to the prior art, the schemes of the present application at least have the following beneficial effect:

In the embodiments of the present application, merely one first component is provided, which thus lowers frequency of blocking the cliff sensor significantly compared with the prior art while rotating, and improves detecting accuracy of the cliff sensor. Furthermore, since the second component does not block the cliff sensor, the number of the second component(s) is not limited, and can be determined as needed by the cleaning equipment, such as several or even dozens of the second component, thereby improving cleaning quality.

BRIEF DESCRIPTION OF THE DRAWINGS

In order to make the technical schemes of the embodiments of the present application or the prior art clearer, accompanying drawings intended to describe the embodiment or the prior art should be briefly described. Obviously, the drawings below are merely some of the embodiments of the present application, those skilled in the art may obtain other embodiments in the light of the drawings below without further creative works.

DETAILED DESCRIPTION OF THE PREFERRED EMBODIMENT

Technical solutions in the embodiments of the present application will be described in detail herein after with reference to the accompanying drawings. Obviously, the embodiments described herein are merely parts of but not exclusive embodiments of the present application. All alternative embodiments obtained by those skilled in the art based on the embodiments of the present application without creative works shall fall within protection scopes of the present application.

Cleaning equipment is provided in an embodiment of the present application, which cleaning equipment can be manual operated equipment, semi-automatic intelligent equipment or full automatic intelligent equipment such as a cleaning robot. For the sake of simplicity and better illustration, the cleaning robot will be illustrated in the embodiment of the present application for illustrative purposes.

Terms of locality used herein such as front, behind, left and right are all determined with reference to a heading direction of the cleaning equipment, the "front" referring to the heading direction of the cleaning equipment. Words such as upper, lower, bottom and top are all determined with reference to a normal placement state when the cleaning equipment is in a normal working state.

First Embodiment

Figure 1:
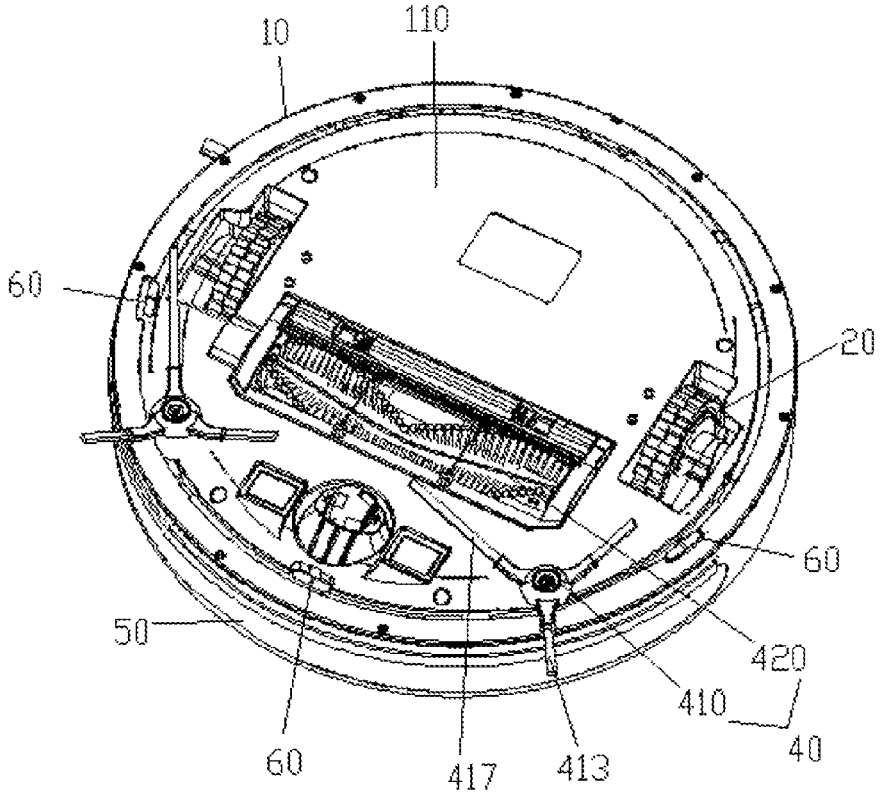
FIG. 1 illustrates a structural schematic diagram of a cleaning equipment according to the first embodiment of the present application.
Figure 2:
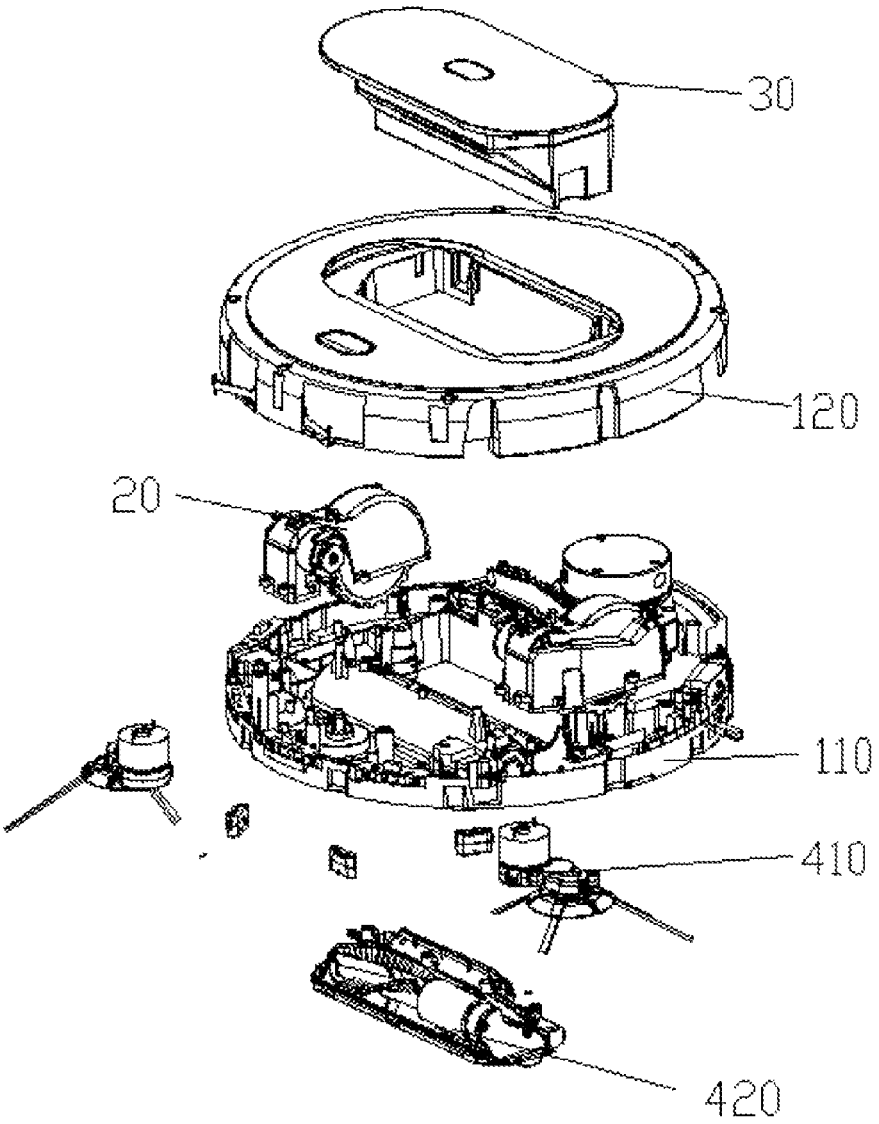
FIG. 2 illustrates a structural schematic diagram of the cleaning equipment which has been disassembled according to the first embodiment of the present application.

Please refer to FIG. 1 and FIG. 2. FIG. 1 illustrates a structural schematic diagram of a cleaning equipment according to the first embodiment of the present application. FIG. 2 illustrates a structural schematic diagram of the cleaning equipment which has been disassembled according to the first embodiment of the present application. The cleaning equipment of the embodiment may include a housing 10, a moving assembly 20, a dirt collecting assembly 30, cliff sensors 60 and a cleaning assembly 40. The moving assembly 20, the dirt collecting assembly 30 and the cleaning assembly 40 may be installed on/in the housing 10 in various ways. The cliff sensor 60 may be arranged on the housing 10, alternatively, arranged on the moving assembly 20 or the cleaning assembly 40. In some cases, there are three cliff sensors 60, and one of them is disposed on the housing, the others are disposed on the moving assembly respectively. In this embodiment, all cliff sensors 60 is arranged on the housing 10 merely for illustrative purpose.

The housing 10 defines general contour of the cleaning equipment. It should be noted that the cleaning equipment shown in FIG. 1 and FIG. 2 is of circular shape which is merely for illustration but not intended to limit the shape of the cleaning equipment. In alternative embodiments, the cleaning equipment can be of circular shape or any other shape such as square, triangle and hexagon. In the embodiment, the housing 10 may include a base plate 110, a frontal bumper 50 and a surface cover 120. When the cleaning equipment is in a normal working state, the base plate 110 faces towards a surface to be cleaned, the surface cover 120 being located on the side away from the surface to be cleaned of the housing 10, the frontal bumper 50 being located between an edge of the base plate 110 and an edge of the surface cover 120.

The moving assembly 20 is configured to move the cleaning equipment. The moving assembly 20 may be a wheel assembly or any other component that may move the cleaning equipment, such as a track or a robotic leg. The moving assembly 20 is installed on the housing 10 which is further provided with a corresponding installation window through which a part of the moving assembly 20 may be accommodated within the housing 10, while leaving the remaining part of the moving assembly 20 outside or protruded from the housing 10.

The dirt collecting assembly 30 is installed in the housing for collecting dirt. The dirt collecting assembly 30 may be a trash bin, a cistern or any other container for collecting dirt. The dirt may include trash, dust, chipping, sewage and other waste which is no longer needed. The dirt collecting assembly 30 may be installed at a middle portion or a rear portion of the housing. The dirt collecting assembly 30 can be detachable; surely, the dirt collecting assembly 30 can also be integrated with the housing in alternative embodiments.

The cliff sensor 60 is arranged at front part of the housing, ahead of wheel and approximate to the edge of the housing 10. Therefore, when a cliff boundary (or a suspending position) exists on the surface to be cleaned (such as a step), the cliff sensor 60 would detect the cliff boundary (or the suspending position) before the wheel reaches the cliff boundary (or the suspending position), thereby redirecting timely and avoiding falling from the cliff boundary (or the suspending position).

The cleaning assembly 40 is arranged combining with the housing 10 for cleaning the surface to be cleaned. In the embodiment, the cleaning assembly 40 may include a first cleaning sub-assembly 410 and a second cleaning sub-assembly 420. The second cleaning sub-assembly 420 may include a dirt absorbing unit (not shown) which is intercommunicated with the dirt collecting assembly 30, the dirt absorbing unit including a vacuum component or a negative pressure generating component. The vacuum component or the negative pressure generating component is configured to generate negative pressure so as to absorb dirt on the surface to be cleaned (such as ground), and collect the dirt on the surface to be cleaned (such as ground) into the dirt collecting assembly 30. The second cleaning sub-assembly 420 also includes at least one rolling bush which rotates around an axis substantially parallel to the ground and contacts with the ground, which rolling bush sweeps the dirt on the ground into the dirt collecting assembly 30. The second cleaning sub-assembly 420 is or includes duster cloth.

At least one first cleaning sub-assembly 410 is provided, preferably, two first cleaning sub-assemblies 410 are provided on two sides of the housing 10 (with reference to the heading direction of the cleaning robot in a normal working state). The first cleaning sub-assembly 410 rotates around an axis which is not parallel to the ground (for example, vertical to the ground) so as to stir the dirt on the surface to be cleaned (such as the ground). The first cleaning sub-assembly 410 may sweep the dirt outside the edge of the housing 10 towards the second cleaning sub-assembly 420 or the dirt collecting assembly 30.

It can be understood that the cleaning equipment may include other parts such as a universal wheel, a controlling circuit for controlling the operation of the cleaning equipment, a communication assembly, a camera, various types of sensors, which are available in the prior art and would not be further described herein.

Furthermore, a plurality of cliff sensors 60 are provided. Preferably, three cliff sensors 60 are provided, one of which is arranged at front end of the housing 10, the other two of which are arranged between the moving assembly 20 and the first cleaning sub-assembly 410.

Figure 3:
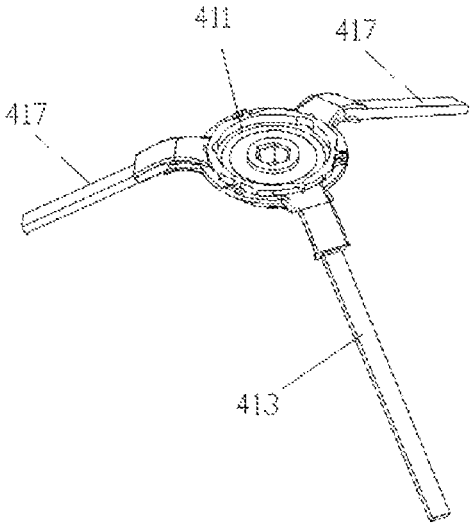
FIG. 3 illustrates a structural schematic diagram of the first cleaning sub-assembly of the cleaning equipment of the first embodiment.
Figure 4:
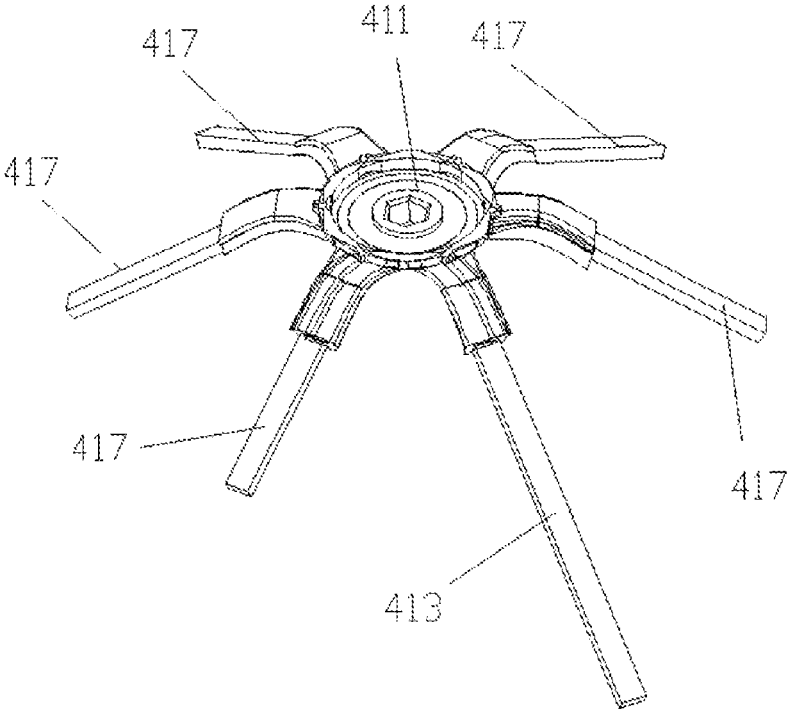
FIG. 4 illustrates a structural schematic diagram of a substitute of the first cleaning sub-assembly of the cleaning equipment of the first embodiment.

Please refer to FIG. 3. FIG. 3 illustrates a structural schematic diagram of the first cleaning sub-assembly of the cleaning equipment of the first embodiment. The first cleaning sub-assembly 410 includes an installing part 411, a first component 413 and at least one second component 417. The first component 413 and the second component 417 are both protruded from the installing part 411. The first component 413 and the second component 417 can rotate along with the rotation of the installing part 411 so as to stir the dirt on the surface to be cleaned. Furthermore, when the cleaning equipment is in a normal working state, the first component 413 moves between the cliff sensor 60 and the surface to be cleaned periodically while rotating, however, the second component 417 does not move between the cliff sensor 60 and the surface to be cleaned periodically while rotating. In one embodiment, the first component 413 is longer than the second component 417, therefore, in the process of rotating, the first component 413 may reach the position where the cliff sensor 60 is located. When the cleaning equipment is in a normal working state, the first component 413 moves between the cliff sensor 60 and the surface to be cleaned periodically while the first cleaning sub-assembly 410 is rotating; furthermore, the first component 413 protrudes from outer side of the edge of the housing 10, and sweeps the dirt outside the edge of the housing towards underneath the cleaning equipment; the length of the second component 417 is set to be unable to reach the cliff sensor 60, which would not block the cliff sensor 60 from transmitting and receiving signal. One or more second components 417 can be arranged. For example, as shown in FIG. 4, five second components 417 are provided.

The first component 413 can be made from bristle, elastic rubber, cloth or fiber; the second component 417 can be made from bristle, elastic rubber, cloth or fiber.

In the embodiment, since only one first component 143 is provided, the first component 143 blocks the cliff sensor 60 in a much lower frequency while rotating relative to the prior art, which improves detecting accuracy of the cliff sensor 60. Furthermore, since the second component 417 does not block the cliff sensor 60, the number of the second cliff sensors 160 is not limited, which can be determined as needed, such as several or even dozens of the second cliff sensors 160, thereby improving cleaning quality and efficiency.

Figure 5:
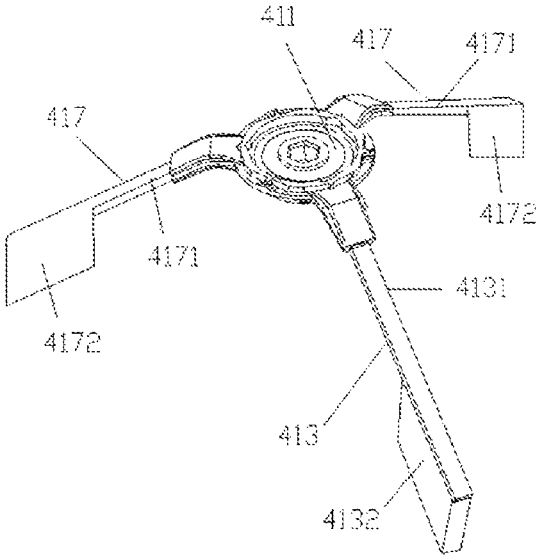
FIG. 5 illustrates a structural schematic diagram of another substitute of the first cleaning sub-assembly of the cleaning equipment of the first embodiment.

Please refer to FIG. 5. FIG. 5 illustrates a structural schematic diagram of a substitute of the first cleaning sub-assembly of the cleaning equipment of the first embodiment. In this substitute of the first cleaning sub-assembly, the first component 413 may include an extending strip 4131, one end of which is connected with the installing part 411, the other end of which is provided with a flexible part 4132. Each of the second components 417 includes an extending strip and a flexible part 4172. The extending strip 4131 is longer than the extending strip 4171, the dimension of the flexible part 4172 being larger or equal to the dimension of the flexible part 4132. The flexible part 4132 and the flexible part 4172 can be both arranged all over the end of the extending strips, or merely arranged on one side of the extending strips. The flexible part 4132 and the flexible part 4172 can be made from bristle, cloth, fiber or elastic material. The flexible part 4132 and the flexible part 4172 may improve flexibility and cleaning capacity of the first cleaning sub-assembly 410, furthermore, dimension of the flexible part can be changed with reference to the vertical direction to the surface to be cleaned. Therefore, in the process of designing, changing shape or dimension of the flexible part 4132 may change acting force between the first cleaning sub-assembly 410 and the surface to be cleaned flexibly, thereby optimizing the cleaning effect.

Second Embodiment

Figure 6A:
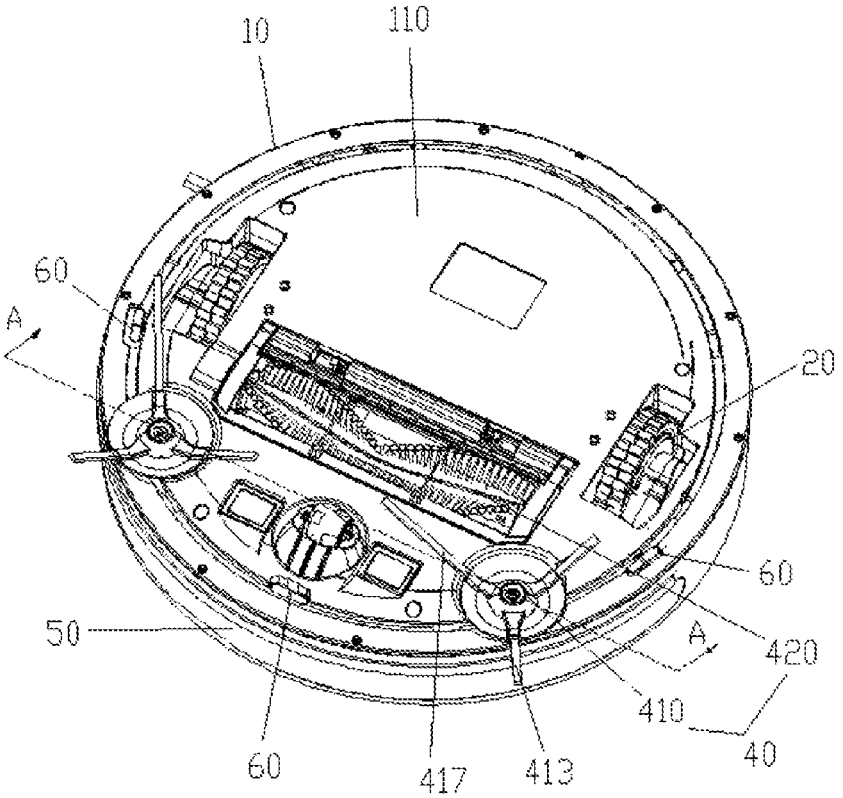
FIG. 6*a* illustrates a structural schematic diagram of a cleaning equipment according to the second embodiment of the present application.
Figure 6B:
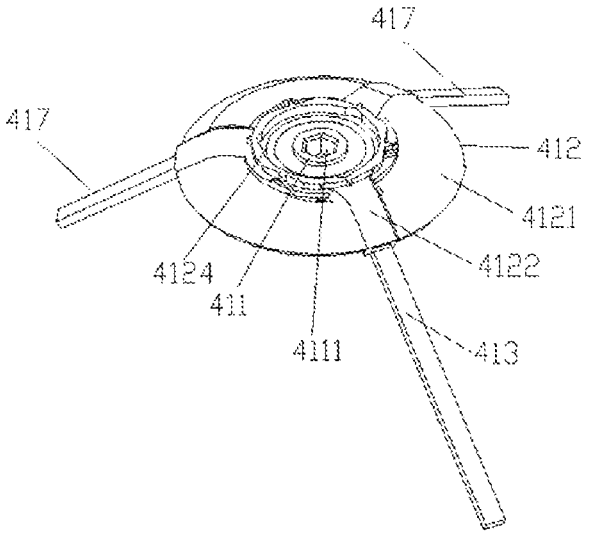
FIG. 6*b* illustrates a structural schematic diagram of a first cleaning sub-assembly of the cleaning equipment according to the second embodiment of the present application.
Figure 6C:
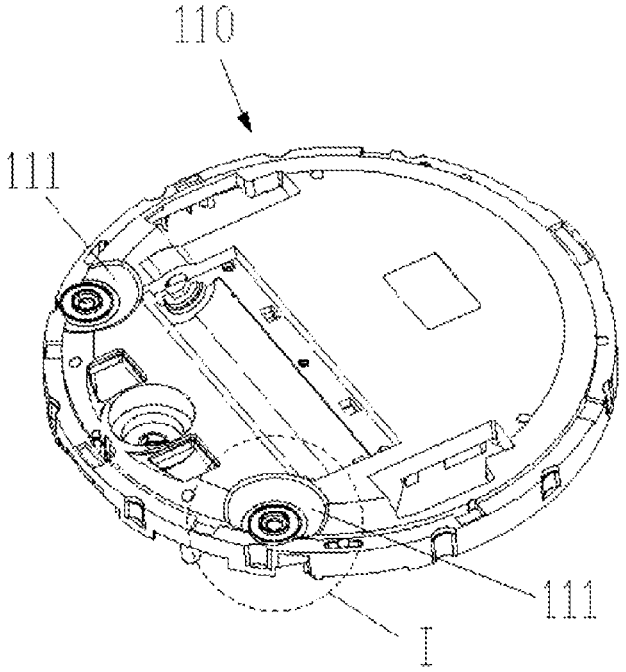
FIG. 6*c* illustrates a structural schematic diagram of a base plate of the cleaning equipment according to the second embodiment of the present application.
Figure 6D:
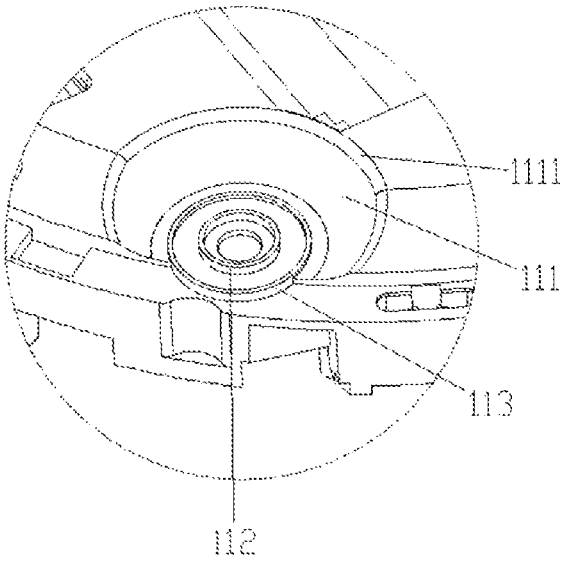
FIG. 6*d* is a partial enlarged diagram of the portion I of FIG. 6*c;*
Figure 6E:
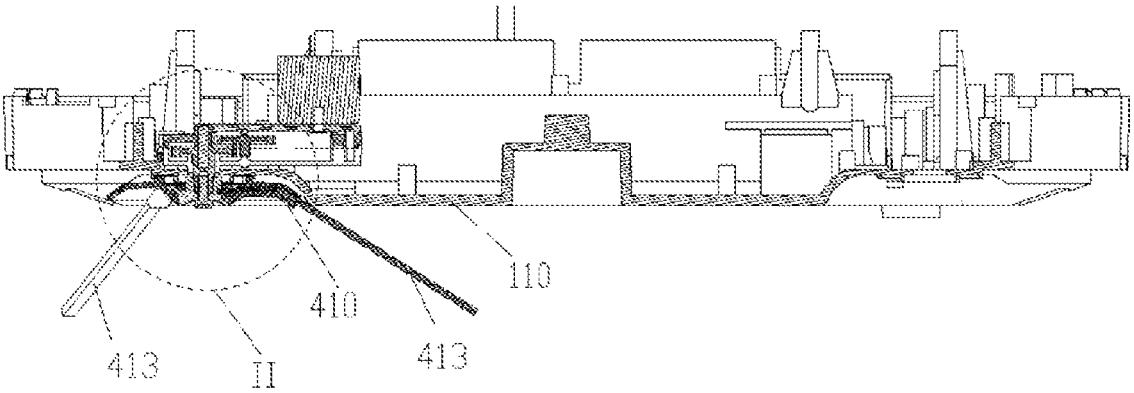
FIG. 6*e* is a sectional view of the first cleaning sub-assembly installed on the base plate according to the second embodiment cut through the section line A-A as shown in FIG. 6*a;*
Figure 6F:
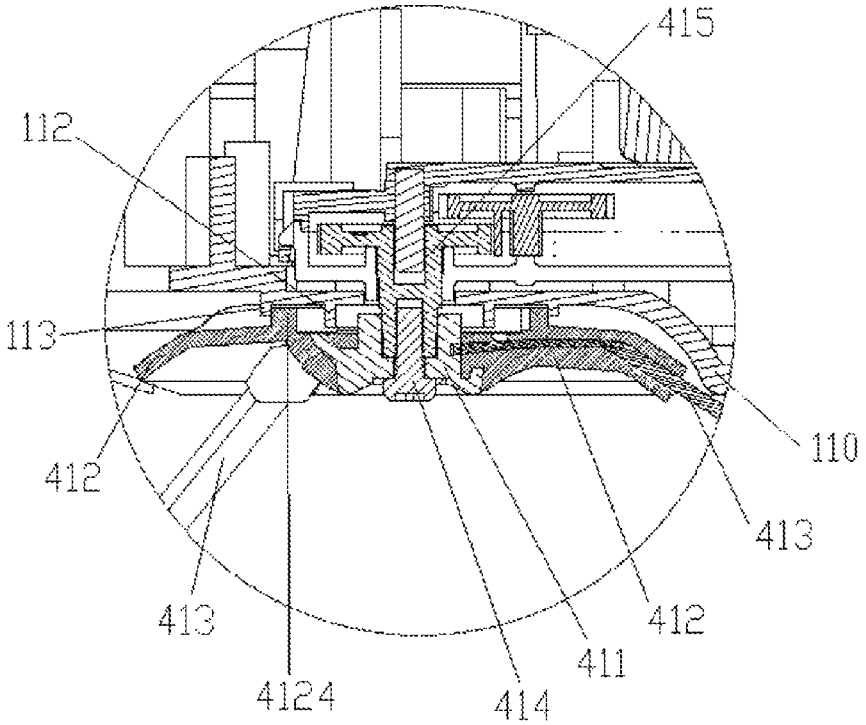
FIG. 6*f* is a partial enlarged diagram of the portion II of FIG. 6*e;*
Figure 6G:
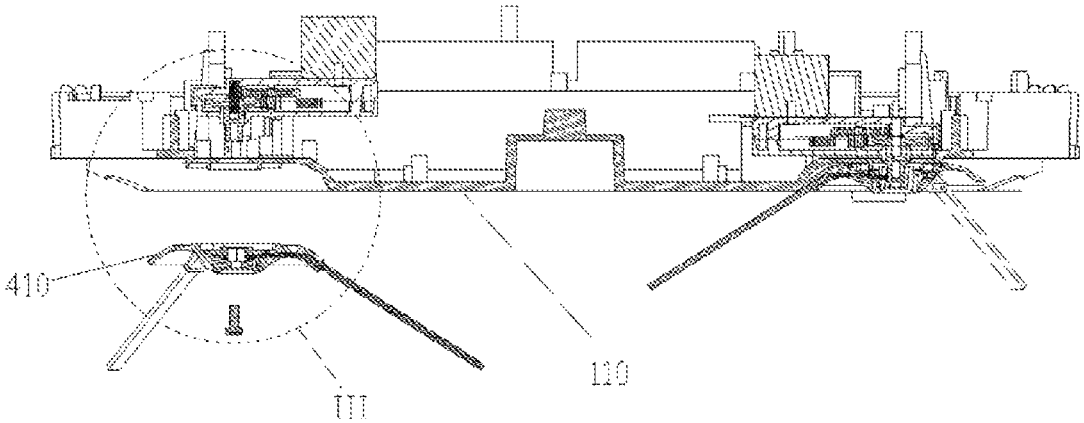
FIG. 6*g* illustrates a structural schematic diagram of the first cleaning sub-assembly and the base plate which are separated from each other according to the second embodiment of the present application.
Figure 6H:
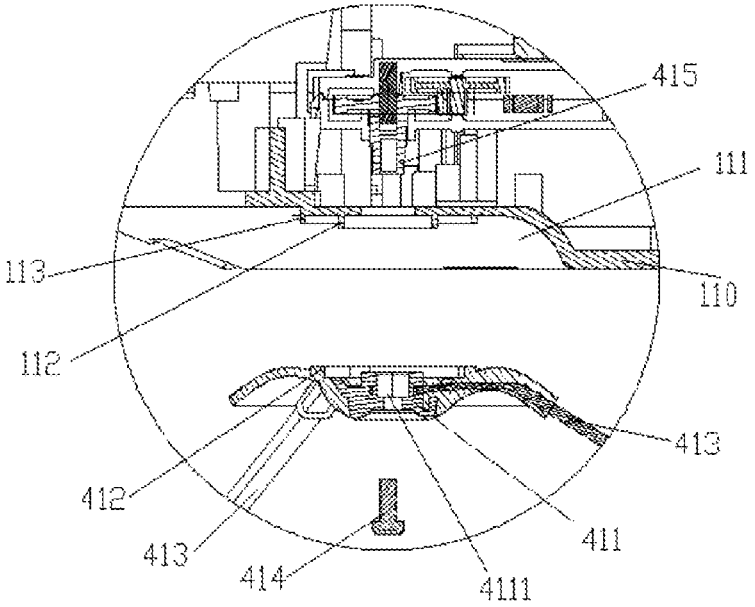
FIG. 6*h* is a partial enlarged diagram of the portion III of FIG. 6*g;*

Please refer to FIGS. 6*a* through 6*h*. FIG. 6*a* illustrates a structural schematic diagram of a cleaning equipment according to the second embodiment of the present application. FIG. 6*b* illustrates a structural schematic diagram of a first cleaning sub-assembly of the cleaning equipment according to the second embodiment of the present application. FIG. 6*c* illustrates a structural schematic diagram of a base plate of the cleaning equipment according to the second embodiment of the present application. FIG. 6*d* is a partial enlarged diagram of the portion I of FIG. 6*c*. FIG. 6*e* is a sectional view of the first cleaning sub-assembly installed on the base plate according to the second embodiment cut through the section line A-A as shown in FIG. 6*a*. FIG. 6*f* is a partial enlarged diagram of the portion II of FIG. 6*e*. FIG. 6*g* illustrates a structural schematic diagram of the first cleaning sub-assembly and the base plate which are separated from each other according to the second embodiment of the present application. FIG. 6*h* is a partial enlarged diagram of the portion III of FIG. 6*g*.

The cleaning equipment illustrated in the second embodiment and the cleaning equipment illustrated in the first embodiment have basically identical characteristic and function, differences being that the first cleaning sub-assembly of the cleaning equipment in the second embodiment further includes a shape stabilizing part 412 which connects a part of the first component 413 close to the installing part 411 with a part of the second component 417 close to installing part 411. Bottom surface of the base plate 110 (towards the surface to be cleaned) is provided with a cavity 111. A surface of the shape stabilizing part close to the base plate 110 is basically a concavity. The shape stabilizing part 412 is received in the cavity 111; the concavity is cooperated with an inner wall of the cavity 111 for avoiding a stripe or a filament from twining the first cleaning sub-assembly 410.

The shape stabilizing part is configured to keep the first component 413 and the second component 417 from deforming or scattering, and keep the stripe or a filament from twining the first cleaning sub-assembly 410. The shape stabilizing part is made from elastic material or other soft material.

Specifically, the shape stabilizing part 412 includes a connecting part 4121 and a coating part 4122. In the case that the first cleaning sub-assembly 410 includes one first component 413 and one second component 417, the connecting part 4121 is located between the first component 413 and the second component 417, the coating part 4122 coating the part of the first component 413 close to the installing part 411 and the part of the second component 417 close to installing part 411. In the case that the first cleaning sub-assembly 410 includes one first component 413 and multiple second components 417, the connecting part 4121 is located between every two second components 417 and between the first component 413 and the second components 417, the coating part 4122 coating the part of the first component 413 close to the installing part 411 and the parts of each of the second components 417 close to installing part 411.

In one embodiment, the connecting part 4121 is thinner than the coating part 4122.

In one embodiment, the connecting part 4121 is made from soft material; the coating part 4122 is made from elastic material.

Furthermore, each of the first component(s) 413 extends outwards from the installing part 411, preferably, the first component 413 and one or more second components 417 extend outwards centered by the installing part 411. Each of the first component 413 and one or more second components 417 may be made from bristle, elastic material (such as elastic rubber), cloth or fiber. At least end portions of the first component 413 and each of the second component(s) 417 are contacted with the surface to be cleaned (such as ground). The cleaning equipment further includes a power unit (not shown) which may include an engine. The first cleaning sub-assembly 410 can be equipped with an engine, alternatively, the first cleaning sub-assembly 410 can share the engine with other parts which require power through a transmission structure. The installing part 411 of the first cleaning sub-assembly 410 is connected to the transmission structure or the engine through a rotating shaft. The installing part 411 is coupled with the rotating shaft 415 through a through hole 4111, the installing part 411 rotating along with the rotation of the rotating shaft; the first component 413 and each second component 417 may rotate along with the rotation of the installing part 411, thereby stirring the dirt on the surface to be cleaned to collect the dirt into the dirt collecting assembly. Preferably, the first component 413 and each second component 417 guide the dirt into the second cleaning sub-assembly 420 such that the second cleaning sub-assembly 420 may collect the dirt into the dirt collecting assembly 30 or wipe the dirt off using a cleaning cloth (in an embodiment where a cleaning cloth exists). The shape stabilizing part 412 is configured to twine around the installing part 411 so as to be connected with the first component 413 and one or more second components 417, thereby providing a constraint between the first component 413 and the second component(s) 417, and between each two of the second components 417, which constraint can be support force, tensile force or restoring force, therefore, the first component 413 and the second component(s) 417 can be kept from being deformed, bristle scattered (if there exists) or converging of the first components, which in turn maintains cleaning capacity of the first cleaning sub-assembly 410, and prolongs the lifespan of the first cleaning sub-assembly 410.

Optionally, the shape stabilizing part 412 extends outwards from peripheral edge of the installing part 411 to a certain point of the first component 413 and the second component 417, for example, to one forth, one third or half of the first component 413, or to one forth, one third or half of the second component 417, specific design being determined according to actual need of the cleaning equipment.

In the embodiment, the installing part 411 and the shape stabilization part 412 are integrated as a whole, or separated from each other. When the installing part 411 and the shape stabilization part 412 are separated, the installing part 411 may be a polystyrene element or any other wear-resisting element.

In the present embodiment, optionally, the shape stabilizing part 412 is elastic, which means that the connecting part 4121 and the coating part 4122 both possess elastic deformation property. Advantages of the shape stabilizing part 412 being configured to be elastic include: the shape stabilizing part 412 is capable of maintaining shapes of the first component 413 and the second component 417, and making the first component 413 and the second component 417 flexible. For example, encountering a barrier, the first component 413 or the second component 417 can be deform to some extent, which reduces impact force, friction and resistance between the first component 413 or the second component 417 and the barrier. Because of the deformation, the shape stabilizing part 412 can be subject to environment by deformation temporally while encountering a barrier, and restore to original shape afterwards, which maintains cleaning capacity and prolongs lifespan of the first component 413 at the same time. Furthermore, because of the buffer function of the elastic material, the noise can be reduced significantly.

It can be understood that in alternative embodiments, the connecting part of the shape stabilizing part 412 can be made from elastic material which is elastic or flexible. For example, the elastic material can be a membrane with elasticity or flexibility.

Furthermore, the first cleaning sub-assembly 410 is installed in the cavity 111 which may reduce the contact between the thing on the surface to be cleaned and the installing part 411 and the rotating shaft 415 of the first cleaning sub-assembly 410. A surface of the shape stabilizing part 412 close to the base plate 110 is generally a concavity. The shape stabilizing part is received in the cavity 111, preferably, the shape stabilizing part 412 and the cavity are generally of the same size, such that the installing part 412 and the rotating shaft 415 can be isolated from the ambient, which further keeps the thing (such as stripe or filament) ambient (includes but not limited to the surface to be cleaned) from entering or twining the installing part 411 and the rotating shaft 415. Optionally, the periphery of the shape stabilizing part 412 is aligned with the periphery 1111 of the cavity, and there is merely a tiny gap between the periphery of the shape stabilizing part 412 and the periphery 1111 of the cavity 111, such that not mutual interference exists between the two peripheries, and foreign matter cannot pass through the gap, which avoids strip (such as electric wire) or filament (such as hair) from twining the first cleaning sub-assembly 410. Interaction between the concavity of the shape stabilizing part 412 and the inner wall of the cavity 111 may effectively avoid strip or filament from twining the first cleaning sub-assembly 410.

Optionally, the inner wall of the cavity 111 is further provided with a first bulge loop 112 and a third bulge loop 113, the concavity of the shape stabilizing part 412 being provided with a second bulge loop 4124. When the first cleaning sub-assembly 410 is installed at the base plate 110, the second bulge loop 4124 of the shape stabilizing part 412 is located between the first bulge loop 112 and the third bulge loop 113. Therefore, the first bulge loop 112, the second bulge loop 4124 and the third bulge loop 113 work together to keep the thing ambient from entering or twining the installing part 411 and the rotating shaft 415. The installing part 411 is sleeve connected to an outer surface of the rotating shaft 415 through the through hole 4111, and installs the installing part 411 at the rotating shaft through a locking part 414. The first cleaning sub-assembly 410 is detachably installed at the housing 10 through the locking part 414. When the first cleaning sub-assembly 410 requires to clean, the first cleaning sub-assembly 410 can be detached from the housing once the locking part is unlocked. The locking part 414 can be any locking mechanism in the prior art such as a bolt or a clip-on locking mechanism. The first bulge loop of the inner wall of the cavity surrounds the outer periphery of the installing part, which further keeps the thing ambient from entering or twining the installing part 411 and the rotating shaft 415.

In the embodiment (the first embodiment), since the first cleaning sub-assembly of the cleaning equipment includes the installing part, the shape stabilizing part, the first component and multiple second components, the multiple second components do not pass through the gap between the housing and the surface to be cleaned while rotating. Therefore, compared with the prior art, the first cleaning sub-assembly reduces the frequency of blocking the cliff sensor and improves the accuracy of the cliff sensor. Furthermore, since the shape stabilizing part is connected to the first component and the second component(s), the shape stabilizing part can provide a constraint between each two of the first components 413, which constraint includes support force, tensile force or restoring force, therefore, the first component can be kept from being deformed, scattered or converging of the first components, which in turn maintains cleaning capacity of the first cleaning sub-assembly, and prolongs the lifespan of the first cleaning sub-assembly. Furthermore, since the base plate of the housing is provided with a cavity, and the periphery of the shape stabilizing part 412 is aligned with the periphery 1111 of the cavity, such that not mutual interference exists between the two peripheries, and foreign matter cannot pass through the gap, which avoids strip (such as electric wire) or filament (such as hair) from twining the first cleaning sub-assembly 410.

Figure 6I:
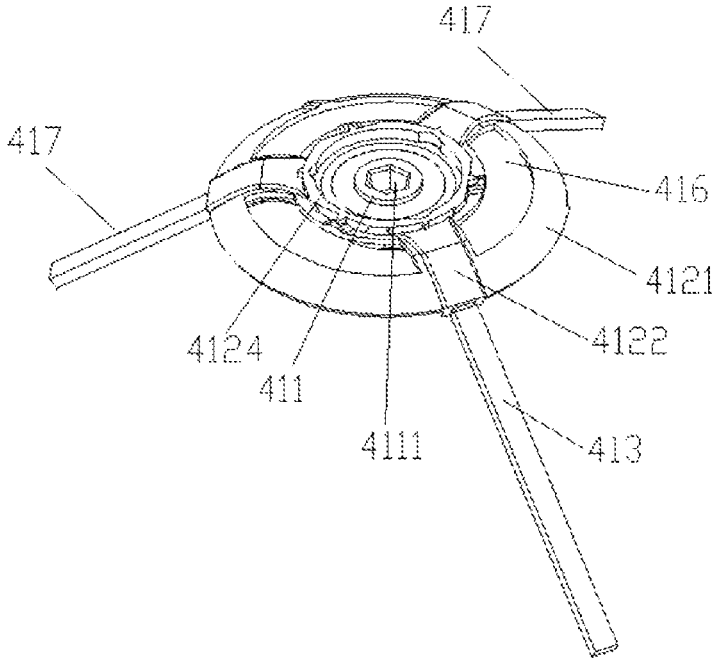
FIG. 6*i* illustrates a structural schematic diagram of a substitute of the first cleaning sub-assembly of the cleaning equipment of the second embodiment.

Please refer to FIG. 6*i*. FIG. 6*i* illustrates a structural schematic diagram of a substitute of the first cleaning sub-assembly of the cleaning equipment of the second embodiment. In the substitute embodiment, the first cleaning sub-assembly includes an installing part 411, a shape stabilizing part 412, a first component 413 and multiple second components 417; the first component 413 and each of the second components 417 extend outwards from the installing part 411, the shape stabilizing part 412 connecting the first component 413 and the multiple second components 417. The shape stabilizing part 411 is carved or ringlike; when the shape stabilizing part 411 is ringlike, a gap exists between the installing part 411 and the shape stabilizing part. Therefore, material is saved and the first component is maintained and limited in position.

In one embodiment, each of the second components 417 and the first component 413 extend outwards from the shape stabilizing part 412, one end of each of the second component 417 and the first component 413 being coated in the shape stabilizing part 412, while the other end extending outwards.

Third Embodiment

Figure 7:
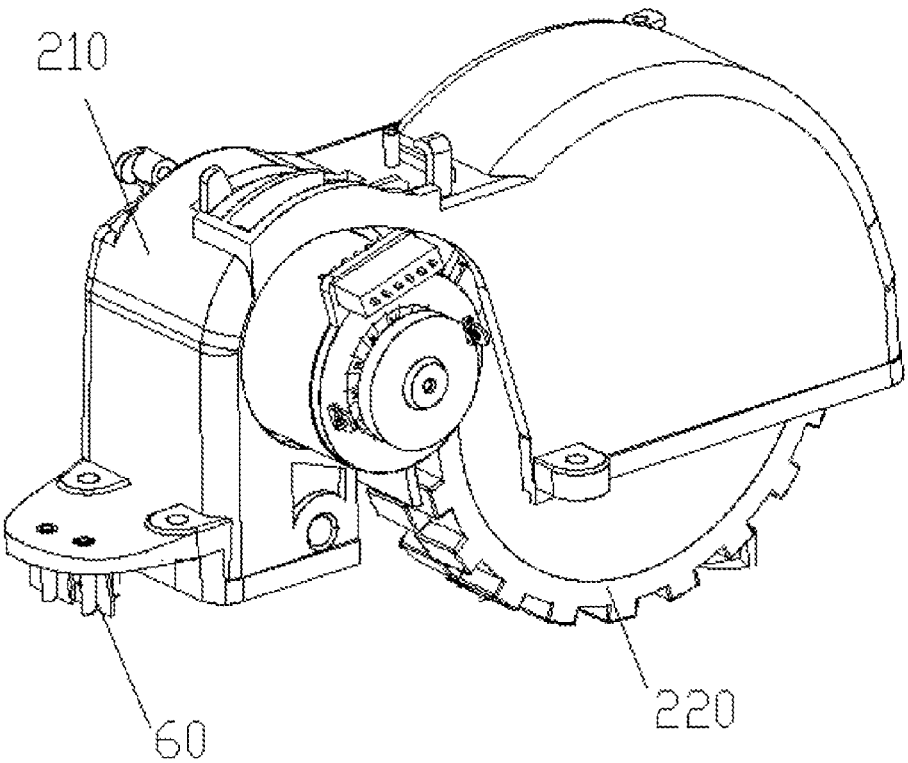
FIG. 7 illustrates a structural schematic diagram of the moving assembly installed with the cliff sensor according to the third embodiment.

Please refer to FIG. 7. FIG. 7 illustrates a structural schematic diagram of the moving assembly installed with the cliff sensor according to the third embodiment. The cleaning equipment in the third embodiment and the cleaning equipment in the first embodiment basically have identical characters, difference being that the moving assembly of the cleaning equipment in the third embodiment is a wheel; the moving assembly 20 is exposed in the ambient through an installing window at the base plate 110; The moving assembly 20 includes a wheel 220 and a wheel cover 210, the cliff sensor 60 being arranged on the wheel cover 210 and exposed to the ambient through the installing window of the base plate 110, such that the cliff sensor 60 may transmit and receive signal.

Specifically, the cliff sensor 60, which is configured to detect the surface to be cleaned, is install on one side of the wheel cover 210 that is closed to the surface to be cleaned. When a cliff boundary (or a suspending position) exists on the surface to be cleaned (such as a step), the cliff sensor 60 would send a signal to a controlling circuit (not shown) of the cleaning equipment, the controlling circuit would control the moving assembly 20 to redirect so as to avoid the cleaning equipment from falling from or being stuck in the cliff boundary (or a suspending position). The cliff sensor 60 may include a signal transmitter and a signal receiver, such as an infrared transmitter and an infrared receiver.

The moving assembly 20 is installed on the base plate 110 through the installing window on the base plate 110, such that a part of the moving assembly may be accommodated within the housing 10, while leaving the remaining part of the moving assembly exposed to the ambient, such that the wheel 220 is contacted with the surface while working, thereby moving the cleaning equipment.

The moving assembly further includes an engine and a transmission structure (not shown) for driving the wheel 220 to rotate. The engine and the transmission structure can be arranged inside the wheel cover 210.

In the present embodiment, the cliff sensor 60 is arranged on the wheel cover 210 with a relatively long distance from the first cleaning sub-assembly 410. The first cleaning sub-assembly 410 would not move between the cliff sensor 60 and the surface to be cleaned while rotating, therefore, the first cleaning sub-assembly 410 would not block the cliff sensor 60 from transmission or receiving signal, thereby improving detecting accuracy of the cliff sensor 60.

In one embodiment, the cliff sensor 60 is arranged on the cleaning assembly 40. Specifically, the cliff sensor 60 can be arranged on the second cleaning sub-assembly 420 of the cleaning assembly 40, alternatively, on the installing part 411 of the first cleaning sub-assembly 410 of the cleaning assembly 40.

In the context, the terms "embodiment", "first embodiment", "an embodiment", "some embodiments", "example", "specific example" or "some examples" are all intended to describe specific character, structure, material or features of the present application. In the specification, the terms above are not necessarily referring to identical embodiment or example. Furthermore, the specific character, structure, material and feature described herein can be combined in an appropriate way in any embodiment. The embodiments described above are merely parts of the present application but not exclusive, any combination of the above characters in the above embodiments falls within protection scope of the present application.

The embodiments described above are not intended to limit the application. Any modifications, alternatives or improvements made within the principle and spirit of the present application should be interpreted as falling within the protection scope of the present application.

What is claimed is:

1. A cleaning equipment comprising, a housing;

a moving assembly, which is arranged partially within the housing, and configured to move the cleaning equipment;

a cleaning assembly, which is arranged partially within the housing, and configured to clean a surface to be cleaned; and at least one cliff sensor, which is arranged on at least one of the housing, the moving assembly and the cleaning assembly, and faces the surface to be cleaned;

wherein, the cleaning assembly comprises at least one first cleaning sub-assembly, each of the at least one first cleaning sub-assembly comprises an installing part, a first component, at least one second component, and a shape stabilizing part; the first component and the at least one second component each extend from the installing part and is capable of rotating along with rotation of the installing part so as to stir dirt on the surface to be cleaned; the shape stabilizing part connects a part of the first component with a part of the second component neighboring the first component; the first component and the at least one second component each pass through the shape stabilizing part;

wherein the housing comprises a base plate, the base plate faces towards the surface to be cleaned when the cleaning equipment is in a normal working state, the base plate defines a cavity, the base plate comprises a first bulge loop and a third bulge loop, the first bulge loop and the third bulge loop are both positioned on an inner wall of the cavity, and the first bulge loop surrounds an outer periphery of the installing part; the shape stabilizing part surrounds the installing part and is received in the cavity, the shape stabilizing part comprises a second bulge loop, and the second bulge loop is located between the first bulge loop and the third bulge loop; the first bulge loop, the second bulge loop and the third bulge loop are capable of working together to keep strips or filaments from entering or twining the installing part.

2. The cleaning equipment of claim 1, wherein a surface of the shape stabilizing part close to the base plate is a concavity, and the concavity is cooperated with the inner wall of the cavity for avoiding the stripes or the filaments from twining the installing part.

3. The cleaning equipment of claim 1, wherein a periphery of the shape stabilizing part is aligned with a periphery of the cavity, and a tiny gap is defined between the periphery of the shape stabilizing part and the periphery of the cavity, such that no mutual interference exists between the periphery of the shape stabilizing part and the periphery of the cavity and no strip or filament is capable of passing pass through the tiny gap.

4. The cleaning equipment of claim 1, wherein the shape stabilizing part is ringlike, and a gap is defined between the installing part and the shape stabilizing part.

5. The cleaning equipment of claim 1, wherein the first component passes through a gap between the cliff sensor and the surface to be cleaned while rotating;

each of the at least one second component does not pass through the gap between the cliff sensor and the surface to be cleaned while rotating;

the at least one second component comprises one second component;

the shape stabilizing assembly comprises a connecting part and a coating part, the connecting part is located between the first component and the second component, the coating part coats a part of the first component close to the installing part and coats a part of the second component close to installing part.

6. The cleaning equipment of claim 5, wherein the connecting part is thinner than the coating part.

7. The cleaning equipment of claim 5, wherein the shape stabilizing part is made of elastic material.

8. The cleaning equipment of claim 1, wherein the first component passes through a gap between the cliff sensor and the surface to be cleaned while rotating;

each of the at least one second component does not pass through the gap between the cliff sensor and the surface to be cleaned while rotating;

the at least one second component comprises multiple second components;

the shape stabilizing assembly comprises a connecting part and a coating part, the connecting part is located between two neighboring second components and between the first component and the second component neighboring the first component, the coating part coats a part of the first component close to the installing part and coats a part of each second component close to installing part.

9. The cleaning equipment of claim 8, wherein the connecting part is thinner than the coating part.

10. The cleaning equipment of claim 8, wherein the shape stabilizing part is made of elastic material.

11. The cleaning equipment of claim 1, wherein each of the first component and the at least one second component comprises an extending strip and a flexible part;

one end of the extending strip is connected with the installing part, the other end of the extending strip is connected with the flexible part.

12. The cleaning equipment of claim 1, wherein the cleaning assembly further comprises a second cleaning sub-assembly which comprises a dirt absorbing unit that is intercommunicated with a dirt collecting assembly;

the first component and the at least one second component are configured to stir the dirt, the dirt absorbing unit is configured to absorb the dirt into the dirt collecting assembly.

* * * * *